US009103498B2

(12) United States Patent
Groothuis et al.

(10) Patent No.: US 9,103,498 B2
(45) Date of Patent: Aug. 11, 2015

(54) METHOD AND APPARATUS FOR VAPORIZING A LIQUID STREAM

(75) Inventors: Casper Krijno Groothuis, The Hague (NL); Irina Tanaeva, The Hague (NL)

(73) Assignee: Shell Oil Company, Houston, TX (US)

( * ) Notice: Subject to any disclaimer, the term of this patent is extended or adjusted under 35 U.S.C. 154(b) by 1061 days.

(21) Appl. No.: 12/374,703

(22) PCT Filed: Jul. 23, 2007

(86) PCT No.: PCT/EP2007/057565

§ 371 (c)(1),
(2), (4) Date: Jan. 22, 2009

(87) PCT Pub. No.: WO2008/012286

PCT Pub. Date: Jan. 31, 2008

(65) Prior Publication Data

US 2010/0000233 A1 Jan. 7, 2010

(30) Foreign Application Priority Data

Jul. 25, 2006 (EP) ..... 06117784

(51) Int. Cl.
*F17C 9/02* (2006.01)
*F17C 5/06* (2006.01)
(Continued)

(52) U.S. Cl.
CPC ... *F17C 5/06* (2013.01); *F17C 9/02* (2013.01); *F28D 15/0266* (2013.01); *F28D 15/043* (2013.01); *F17C 2221/033* (2013.01);
(Continued)

(58) Field of Classification Search
CPC ..... F17C 9/02; F28D 15/0266
USPC ..... 165/104.14, 104.21, 104.26; 62/50.2
See application file for complete search history.

(56) References Cited

U.S. PATENT DOCUMENTS 2,119,091 A * 5/1938 Atkinson et al. ..... 196/119
2,273,257 A 2/1942 Gardner ..... 62/1
(Continued)

FOREIGN PATENT DOCUMENTS

AT 392838 B 6/1991
CN 1090915 A 8/1994
(Continued)

OTHER PUBLICATIONS

Zhang et al., "Configuration analysis of a novel zero CO2 emission cycle with LNG cryogenic exergy utilization", IMECE2003-41958, Proceedings of IMECE, Nov. 16-21, 2003.*
(Continued)

*Primary Examiner* — Cassey D Bauer
*Assistant Examiner* — Orlando E Aviles Bosques

(57) ABSTRACT

A method for vaporizing a liquid stream includes cycling a heat transfer fluid in a closed circuit; feeding the heat transfer fluid to a first heat transfer zone; feeding a liquid stream to be vaporized to the first heat transfer zone; providing heat from the heat transfer fluid to the liquid stream in the first heat transfer zone thereby vaporizing the liquid stream and at least partially condensing the heat transfer fluid; removing the vaporized liquid stream and the at least partially condensed heat transfer fluid and passing the latter to a second heat transfer zone; providing heat from ambient air to the at least partially condensed heat transfer fluid thereby vaporizing the heat transfer fluid; recycling the vaporized heat transfer fluid to the first heat transfer zone using gravitational force exerted on the heat transfer fluid being cycled in the closed circuit.

27 Claims, 3 Drawing Sheets

Figure 1:
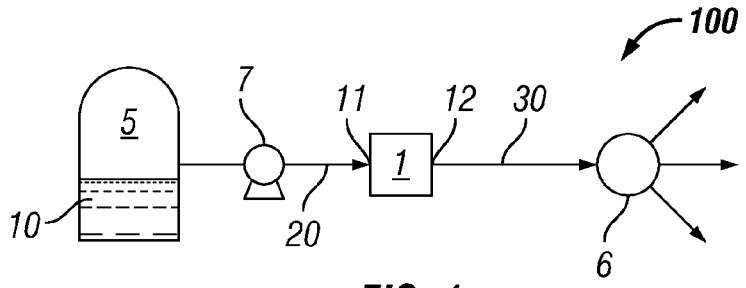

(51) Int. Cl.

| | |
|---|---|
| ***F28D 15/02*** | (2006.01) |
| ***F28D 15/04*** | (2006.01) |
| *F28D 21/00* | (2006.01) |

(52) U.S. Cl.

CPC ... *F17C2223/0161* (2013.01); *F17C 2223/033* (2013.01); *F17C 2223/046* (2013.01); *F17C 2225/0123* (2013.01); *F17C 2225/035* (2013.01); *F17C 2227/0135* (2013.01); *F17C 2227/0311* (2013.01); *F17C 2227/0323* (2013.01); *F17C 2227/0393* (2013.01); *F17C 2270/0136* (2013.01); *F28D 2021/0066* (2013.01)

(56) References Cited

U.S. PATENT DOCUMENTS

| | | | | | |
|---|---|---|---|---|---|
| 2,350,348 | A | | 12/1942 | Gaugler | |
| 2,499,736 | A | * | 3/1950 | Af Kleen | 165/104.14 |
| 3,229,759 | A | | 1/1966 | Grover | 165/105 |
| 3,887,759 | A | * | 6/1975 | Staub et al. | 174/15.1 |
| 4,027,728 | A | * | 6/1977 | Kobayashi et al. | 165/104.27 |
| 4,237,866 | A | * | 12/1980 | Rush | 165/104.25 |
| 4,343,156 | A | | 8/1982 | Gauthier | 62/52 |
| 4,485,670 | A | | 12/1984 | Camarda et al. | 73/179 |
| 4,995,234 | A | * | 2/1991 | Kooy et al. | 60/648 |
| 5,195,575 | A | * | 3/1993 | Wylie | 165/132 |
| 5,485,670 | A | | 1/1996 | Bouman et al. | 29/732 |
| 5,803,161 | A | * | 9/1998 | Wahle et al. | 165/104.21 |
| 5,931,156 | A | * | 8/1999 | Wang et al. | 126/635 |
| 6,026,889 | A | * | 2/2000 | Pase, Sr. | 165/104.21 |
| D425,013 | S | * | 5/2000 | Lai | D13/102 |
| 2003/0019219 | A1 | * | 1/2003 | Viegas et al. | 62/50.2 |
| 2004/0028578 | A1 | | 2/2004 | Zardi | |
| 2005/0274126 | A1 | | 12/2005 | Baudat | 62/50.2 |
| 2006/0242969 | A1 | | 11/2006 | Minton et al. | 62/50.2 |
| 2010/0000233 | A1 | | 1/2010 | Groothuis et al. | |

FOREIGN PATENT DOCUMENTS

| | | | | |
|---|---|---|---|---|
| EP | 550845 | | 7/1993 | F17C 9/02 |
| EP | 604982 | | 7/1994 | F17C 9/02 |
| EP | 450906 | | 11/1994 | F17C 9/02 |
| EP | 915311 | | 5/1999 | F25J 3/00 |
| JP | 54057222 | | 5/1979 | F17C 9/02 |
| JP | 55-101710 | A | 8/1980 | |
| JP | 56-24036 | A | 3/1981 | |
| JP | 63-076652 | | 5/1988 | |
| JP | H1180100 | | 1/1989 | |
| JP | 03286991 | | 12/1991 | F28D 5/00 |
| JP | 2001200995 | A | 7/2001 | |

OTHER PUBLICATIONS

De Souza et al., "An Experimental Investigation of a CO2 Pulsating Heat Pipe", 14th International Heat Pipe Conference (14th IHPC), Florianópolis, Brazil, Apr. 22-27, 2007.*

Zarling et al., "Thermosiphon-Based Designs and Applications for Foundations Built on Permafros", International Arctic Technology Conference, May 29-31, 1991, Anchorage, Alaska.*

MSDS R744; BOC Gases; Dec. 13, 2005.*

R744; The Linde Group; retreived from the internet on Feb. 10, 2014.*

Worthington W.S., et al: "Improved Regasification Methods Reduce Emissions", Hydrocarbon Processing, Jul. 2005, pp. 51-54.

International Search Report dated Sep. 25, 2007 (PCT/EP2007/057565).

Joseph H Cho et al "Applicabilities and Limitations of LNG Vaporization Processes", LNG Journal Jun. 2005, pp. 24-26.

GM Grover et al "Structures of Very High Termal Conductivity", J. Appl. Phys. vol. 35, staring p. 1990 (1964).

Amir Faghri, "Heat Pipe Science & Technology", Taylor and Francis, 1995; pp. 1-33 and 578-593.

English Translation of Office Action issued by Japanese Patent Office on Jun. 15, 2012, including select figures annotated with English text.

PCT International Search Report, Application No. PCT/EP2013/062181 dated Feb. 13, 2014.

* cited by examiner

METHOD AND APPARATUS FOR VAPORIZING A LIQUID STREAM

The present application claims priority from European Patent Application 06117784.6 filed 25 Jul. 2006.

FIELD OF THE INVENTION

The present invention relates to a method for vaporizing a liquid stream, in particular a liquid hydrocarbon stream such as liquefied natural gas (LNG). In particular the present invention relates to the vaporisation (sometimes also referred to with the term 'regasification') of LNG at an LNG import terminal.

BACKGROUND OF THE INVENTION

LNG is usually primarily liquefied methane containing varying quantities of ethane, propane and butanes with trace quantities of pentanes and heavier hydrocarbon components. Usually the LNG is low in aromatic hydrocarbons and non-hydrocarbons such as $H_2O$, $N_2$, $CO_2$, $H_2S$ and other sulphur compounds, and the like, as these compounds have usually been removed at least partially before liquefying the natural gas stream, which is then stored or transported in liquid form. For the purpose of this description, 'hydrocarbon stream', 'LNG' or 'natural gas' should not be construed to be limited to a certain composition, but rather be seen as a liquid stream in general, in particular a hydrocarbon containing stream.

It is desirable to liquefy natural gas for a number of reasons. As an example, natural gas can be stored and transported over long distances more readily as a liquid than in gaseous form, because it occupies a smaller volume and does not need to be stored at high pressures.

In order to regasify the LNG stream it is usually pressurized and vaporised. If desired a selected amount of e.g. $N_2$ is added to obtain natural gas having a desired gas quality, e.g. a selected heating value (i.e. energy content when the gas is burned), according to gas specifications or the requirements of a consumer. Alternatively or additionally, the heating value of the natural gas may be adjusted by removing or adding a desired amount of ethane and/or heavier hydrocarbons from the natural gas.

An example of a method for the regasification or vaporization of LNG of the so-called 'intermediate fluid type' is disclosed in US 2005/0274126 A1. More particularly, US 2005/0274126 describes a method and apparatus for vaporizing cryogenic fluids such as LNG in which an intermediate heat transfer fluid is first heated across a heat transfer surface with ambient air and then the heat transfer surface provide heat to vaporize the cryogenic fluid.

A problem of the known method of regasifying or vaporizing LNG is that relatively high capital expenses (CAPEX) have to be made.

SUMMARY OF THE INVENTION

It is an object of the present invention to minimize the above problem.

It is a further object to provide an alternative intermediate fluid type method of vaporizing a liquid stream, in particular regasifying LNG.

One or more of the above or other objects are achieved according to the present invention by providing a method for vaporizing a liquid stream, in particular a liquid hydrocarbon stream such as liquefied natural gas, the method at least comprising the steps of:

a) feeding a heat transfer fluid to a first heat transfer zone, the heat transfer fluid being cycled in a closed circuit;

b) feeding a liquid stream to be vaporized to the first heat transfer zone;

c) providing heat from the heat transfer fluid to the liquid stream across a heat transfer surface in the first heat transfer zone thereby vaporizing the liquid stream and at least partially condensing the heat transfer fluid;

d) removing the vaporized liquid stream obtained in step c);

e) removing the at least partially condensed heat transfer fluid obtained in step c) and passing it to a second heat transfer zone;

f) providing heat from ambient air to the at least partially condensed heat transfer fluid across a heat transfer surface in the second heat transfer zone thereby vaporizing the heat transfer fluid;

g) recycling the vaporized heat transfer fluid to the first heat transfer zone;

wherein the heat transfer fluid is recycled in step g) using gravitational force exerted on the heat transfer fluid being cycled in the closed circuit.

DETAILED DESCRIPTION OF THE INVENTION

It has surprisingly been found that using the method according to the present invention, the CAPEX can be significantly reduced. As according to the present invention gravitational force exerted on the heat transfer fluid is used for the cycling of it in the closed circuit, the cost for pumps and the like can be minimized. In some cases no pumps at all may be needed for the circulation of the heat transfer fluid in the closed circuit.

A further advantage of the present invention is that using the method according to the present invention less plot space may be needed for vaporizing a liquid stream.

Preferably in step e) the heat transfer fluid flows downwards from the first heat transfer zone to the second heat transfer zone. Further it is preferred that in step g) the heat transfer fluid flows upwards from the second heat transfer zone to the first heat transfer zone.

In this way the gravity force enables the circulation of the heat transfer fluid. This effect, combined with the density difference between the downwards and upwards flowing parts of the heat transfer fluid allows the minimization of mechanical pumps for circulation of the heat transfer fluid inside the closed circuit.

The heat transfer fluid may be any suitable fluid under the operating conditions and includes hydrocarbons such as propane and butane, halogenated hydrocarbons such as freons, ammonia, glycol-water mixtures, formate-water mixtures, methanol, propanol, etc.

Preferably, the heat transfer fluid has a boiling point below 5° C., preferably from −10 to 0° C., at the prevailing pressure in the closed circuit. Preferably the heat transfer fluid comprises a compound that is selected from the group consisting of $CO_2$, ethane, ethene, propane, propene, butane, and a mixture thereof.

According to a particularly preferred embodiment the heat transfer fluid comprises >90 mole % $CO_2$, more preferably about 100 mole % $CO_2$. An important advantage of $CO_2$ when used for vaporizing LNG is that—if a leak occurs in the closed circuit for the heat transfer fluid—, the $CO_2$ will solidify at the leakage point thereby reducing or even blocking the leakage point. Moreover, $CO_2$ doesn't result in flammable mixtures if it would leak from the closed circuit. The boiling point of $CO_2$ is at −5.8 to −0.1° C. at pressures of from 30 to 35 bar.

The person skilled in the art will understand that the first and second heat transfer zones may have various designs, and that the present invention is not limited to a certain design provided that a suitable heat transfer contact between the respective streams is possible. Preferably the heat transfer contact in the first and second heat transfer zones is indirect, i.e. no physical contact between the respective streams takes place. A preferred example of the second heat transfer zone in the case of regasification of LNG makes use of the so-called "heat pipe" principle (or the "two-phase closed thermosyphon" principle). As the "heat pipe" principle is known as such (see e.g.: U.S. Pat. No. 3,229,759 and U.S. Pat. No. 5,485,670), this is not further discussed here.

Further the person skilled in the art will readily understand that the first and second heat transfer zones may comprise several heat transfer surfaces. Also one or more closed circuits for heat transfer fluids may be used for each and any heat transfer surface.

In a further aspect the present invention relates to an apparatus for vaporizing a liquid stream, in particular a liquid hydrocarbon stream such as liquefied natural gas, the apparatus at least comprising:

a first heat transfer zone having a heat transfer surface across which a liquid stream to be vaporized can heat exchange against a heat transfer fluid;

a second heat transfer zone having a heat transfer surface across which the heat transfer fluid can heat exchange against ambient air;

a closed circuit for the heat transfer fluid;

wherein the second heat transfer zone is situated gravitationally lower than the first heat transfer zone Preferably the first heat transfer zone comprises a plurality of substantially parallel tubes for the liquid to be vaporized. Further it is preferred that at least a part of the walls of the tubes can be used as the heat transfer surface in the first heat transfer zone.

According to a preferred embodiment the first heat transfer zone is supported by a support frame. Preferably the closed circuit for the heat transfer fluid forms part of the support frame. Further it is preferred that one or more closed circuits are present, the one or more closed circuits forming one or more support legs in the support frame. In an especially elegant embodiment the support frame comprises first and second support legs defining an angle $\alpha$ between them, preferably an angle $\alpha$ from 30 to 90°, preferably about 60°. As a result it may be the case that no pump is present for circulation of the heat transfer fluid in the closed circuit.

In an even further aspect the present invention provides the use of $CO_2$ as a heat transfer fluid or as a component thereof. In particular the heat transfer fluid is intended for vaporizing a fluid, wherein the fluid to be vaporized has a temperature below 5° C., preferably from −170 to 0° C.

Figure 2:
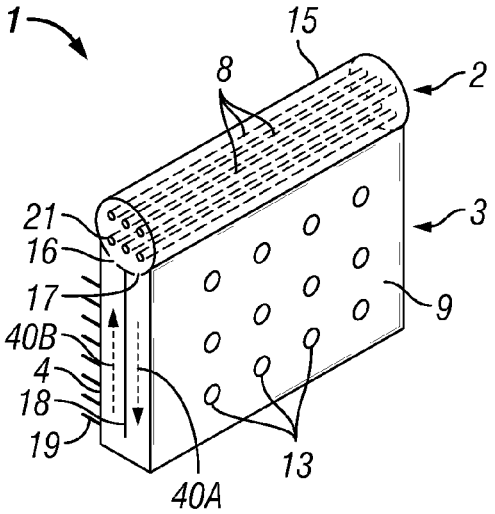
Figure 3:
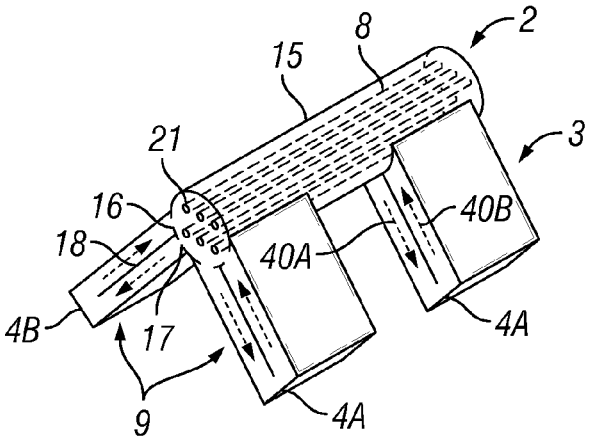
Figure 4:
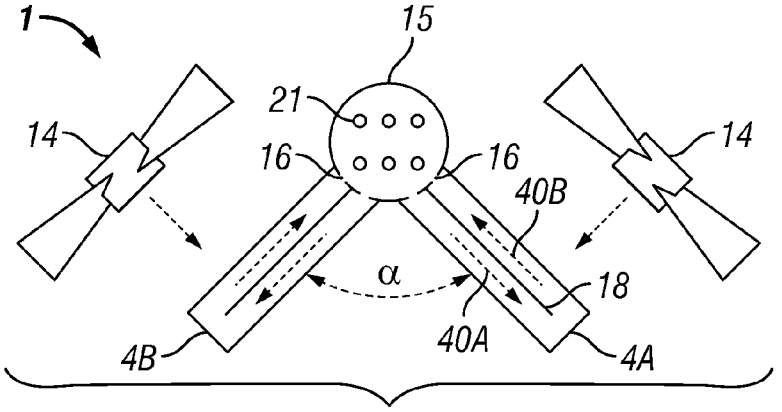
Figure 5:
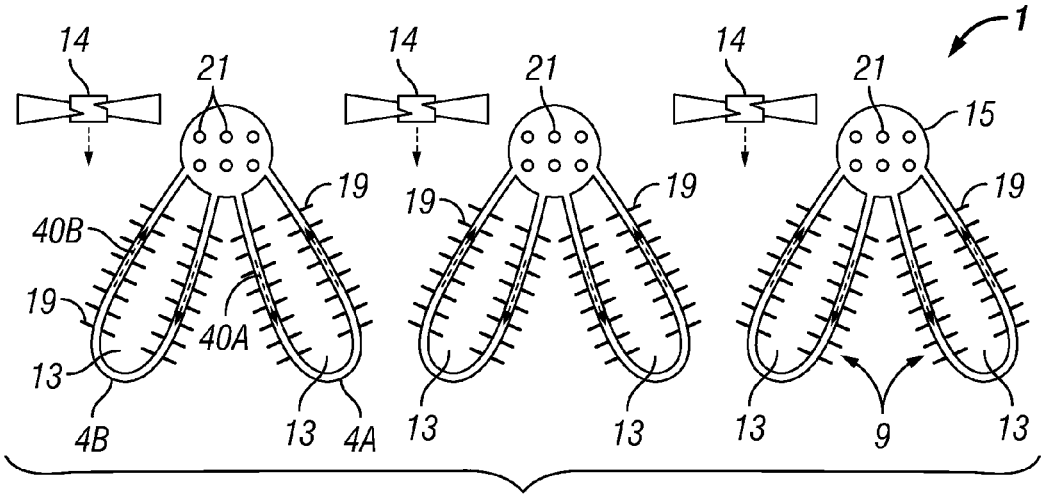
Figure 6:
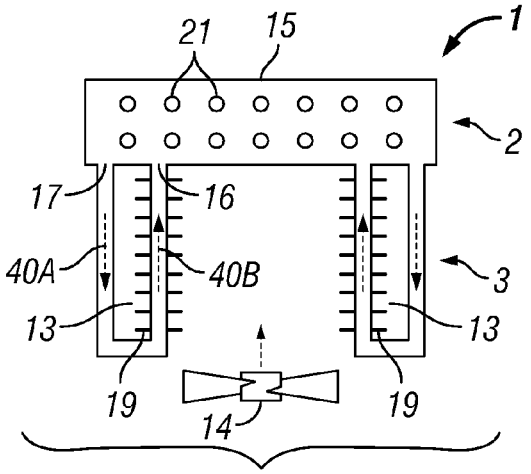
Figure 7:
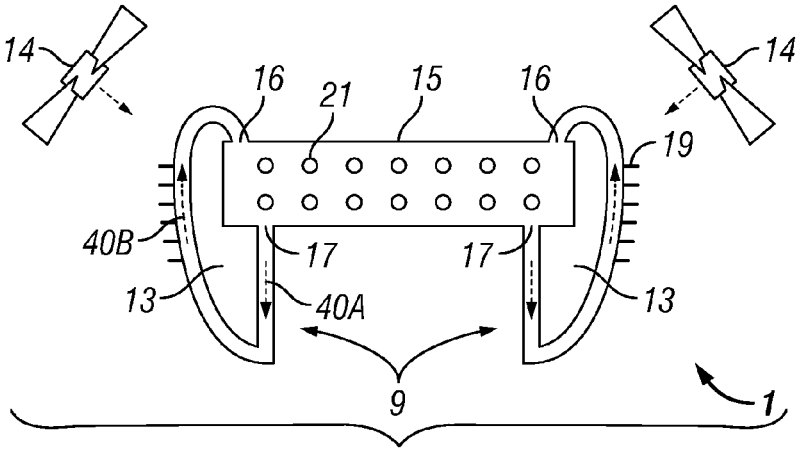
Figure 8:
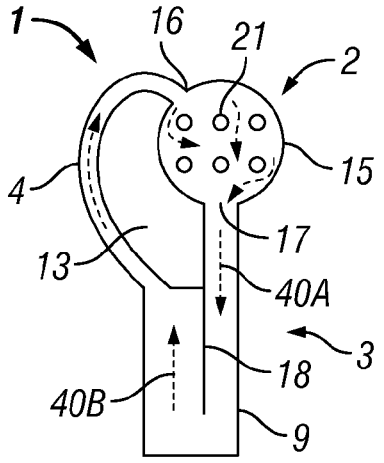
Figure 9:
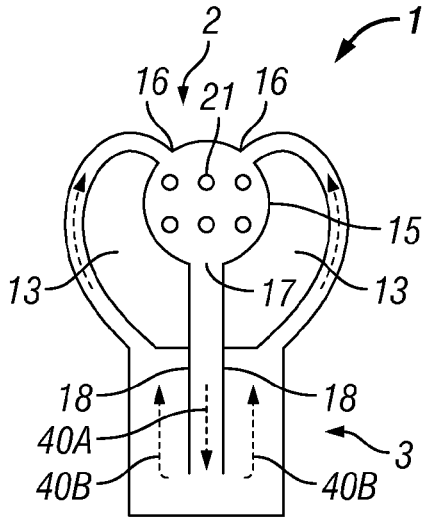
Figure 10:
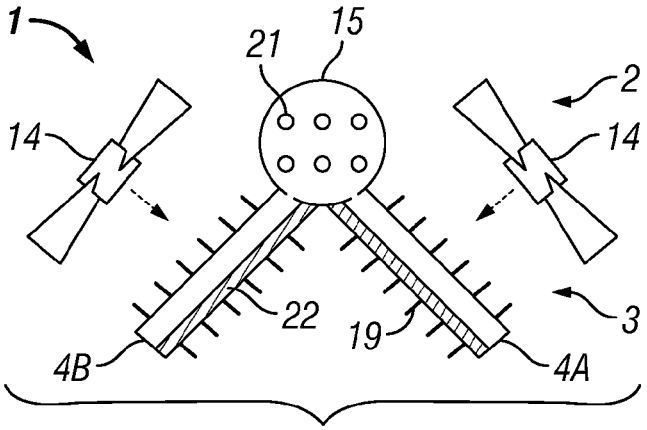

Hereinafter the invention will be further illustrated by the following non-limiting drawings. Herein shows:

FIG. 1 schematically an exemplary process line-up in which an apparatus according to the present invention is incorporated;

FIG. 2 schematically a perspective view of an apparatus in accordance with a first embodiment of the present invention;

FIG. 3 schematically a perspective view of an apparatus in accordance with a second embodiment of the present invention;

FIG. 4 schematically a cross-sectional view of the apparatus of FIG. 3;

FIG. 5 schematically a cross-sectional view of an apparatus in accordance with a third embodiment of the present invention;

FIG. 6 schematically a cross-sectional view of an apparatus in accordance with a fourth embodiment of the present invention;

FIG. 7 schematically a cross-sectional view of an apparatus in accordance with a fifth embodiment of the present invention;

FIG. 8 schematically a cross-sectional view of an apparatus in accordance with a sixth embodiment of the present invention;

FIG. 9 schematically a cross-sectional view of an apparatus in accordance with a seventh embodiment of the present invention;

FIG. 10 schematically a cross-sectional view of an apparatus in accordance with an eighth embodiment of the present invention.

For the purpose of this description, a single reference number will be assigned to a line as well as a stream carried in that line. Same reference numbers refer to similar components.

FIG. 1 schematically shows a process line-up 100 in which an apparatus according to the present invention (generally referred to with reference No. 1) is incorporated. More particularly, FIG. 1 shows a regasification line-up at an LNG import terminal.

From an LNG storage tank 5 for liquefied natural gas 10 an (usually sub-cooled) LNG stream 20 is removed by use of a pump 7. The pump 7 passes the LNG 20 to the inlet 11 of the vaporizer (or 'regasifier') 1 in which the LNG is vaporized using a heat transfer fluid (to be discussed while referring to FIG. 2) thereby obtaining gaseous natural gas stream 30 that (after removing from outlet 12) may be sent to the grid or gas pipe network 6. It goes without saying that the LNG stream 20 may also be provided from another source than the storage tank 5, such as directly from an offloading line of a LNG transport vessel. Further, if desired, there may be a back-up heater (not shown) such as a fired heater to provide extra heat to either the heat transfer fluid, the LNG stream 20 or the (only partly) vaporized stream 30 thereby ensuring that all LNG in stream 30 is vaporized before it is sent to the gas pipe network 6.

FIG. 2 schematically shows a perspective view of a vaporizer (or regasifier) 1 in accordance with a first embodiment of the present invention.

The vaporizer 1 comprises a first heat transfer zone 2 having a heat transfer surface across which the LNG to be vaporized can heat exchange against a heat transfer fluid being cycled in a closed circuit 4. Preferably the heat transfer fluid is $CO_2$. The pressure of the heat transfer fluid may be varied depending on the ambient conditions in order to maximize heat transfer and to minimize ice formation on the outside of the apparatus 1.

The first heat transfer zone 2 contains a closed box 15 in which a plurality of substantially parallel tubes 8 (indicated with dashed lines) for the LNG stream to be vaporized (referred to with 20 in FIG. 1) are housed. To this end the LNG stream 20 is fed into the inlets 21 of the tubes 8 (which inlets 21 may be connected to a combined inlet of the vaporizer 1, such as the LNG inlet 11). In the embodiment of FIG. 2 the walls of the tubes 8 are used as the heat transfer surface of the first heat transfer zone 2, wherein the heat transfer fluid cycled in the closed circuit 4 can freely flow around the tubes 8 in the space defined by the walls of the tubes 8 and the inner wall of the box 15. To this end the heat transfer fluid is fed into box 15 at inlet 16 and removed from the box 15 at outlet 17.

The first heat transfer zone 2 is supported by a support frame 9.

Further the vaporizer 1 comprises a second heat transfer zone 3 in which the heat transfer fluid cycled in the closed circuit 4 can heat exchange against ambient air.

In the embodiment of FIG. 2 the closed circuit 4 for the heat transfer fluid as well as the second heat transfer zone 3 form part of the support frame 9. As a result the second heat transfer zone 4 is situated gravitationally lower than the first heat transfer zone 2.

To achieve improved indirect heat transfer between ambient air and heat transfer fluid in the second heat transfer zone 3, e.g. through going holes 13 are present in the support frame 9. As indirect heat transfer takes place, there is no direct contact between air and the heat transfer fluid in the closed circuit 4. It goes without saying that the through going holes 13 may take any suitable shape including a slit like shape.

If desired, a fan (14; as shown in e.g. FIG. 4) may be present to increase ambient air circulation to improve the heat transfer between the heat transfer fluid and the ambient air in the second heat transfer zone 3. Also, the surface of the second heat transfer zone 3 may be adapted to improve heat transfer, e.g. by use of fins (19; see e.g. FIG. 5) and grooves or the like.

During use of the embodiment of FIG. 2, the heat transfer fluid in the closed circuit 4 and the LNG to be vaporized are fed (sequentially or simultaneously) to the first heat transfer zone 2. Then, by indirect heat exchange contact between the heat transfer fluid and the LNG across the walls of the tubes 8 in the first heat transfer zone 2, the LNG is heated and leaves the first heat transfer zone 2 in evaporated form (as stream 30 at outlet 12 in FIG. 1).

The heat transfer fluid is cooled and thereby at least partially condensed in the first heating zone 2. Subsequently, the at least partially condensed heat transfer fluid is passed to the second heat transfer zone 3 in which it is heated by ambient air across the heat transfer surface in the second heat transfer zone 3. As a result the heat transfer fluid is vaporized and recycled to the first heat transfer zone 2. If desired, additional heat (in addition to the ambient air) may be used to heat the heat transfer fluid; this additional heat may e.g. be obtained from solar cells or the like.

The heat transfer fluid in the closed circuit 4 is recycled using gravitational force. This gravitational force, combined with the density difference between the (colder and heavier) downwards flowing part 40A and (warmer and lighter) upwards flowing part 40B of the heat transfer fluid in the closed circuit 4 allows the minimization of mechanical pumps for circulation of the heat transfer fluid inside the closed circuit 4. In a preferred embodiment no pump at all is used for circulation of the heat transfer fluid in the closed circuit 4.

In FIG. 2, the downwards flowing part 40A and the upwards flowing part 40B are separated by a separation wall 18 which is preferably isolated. If desired, and to improve airflow at the second heat transfer zone 3, the second heat transfer zone 3 may comprise separate tubes or bundles of tubes for the downwards flowing part 40A and the upwards flowing part 40B; so in that case the separation wall 18 may be (at least partly) omitted (see also FIG. 5).

FIG. 3 shows schematically a perspective view of an apparatus in accordance with a second embodiment of the present invention. In FIG. 3, more than one closed circuit (identified by type 4*a* and 4*b*) is used for circulating the heat transfer fluid. It goes without saying that any suitable amount of (usually parallel) closed circuits may be used for circulating the heat transfer fluid between the first and second heat transfer zones 2, 3. As also discussed in respect of FIG. 2, the closed circuits 4*a* and 4*b* of the second heat transfer zone 3 may comprise separate tubes or bundles of tubes for the downwards flowing part 40A and the upwards flowing part 40B.

In the embodiment of FIG. 3 the closed circuits 4*a*, 4*b* form part of the support frame 9 for the first heat transfer zone 2; the circuits 4*a*, 4*b* are used as first and second support legs in the support frame 9, respectively. It goes without saying that apart from the closed circuits 4*a*, 4*b* further structural elements may be present to support the first heating zone 2.

FIG. 4 schematically shows a cross-sectional view of the apparatus 1 of FIG. 3. As shown an angle $\alpha$ is defined by the support legs of the support frame 9. The closed circuits 4*a* and 4*b* form part of the support frame 9. Preferably, the angle $\alpha$ is from 30 to 90°, preferably about 60°.

Further, in FIG. 4 the use of fans 14 is shown to force the ambient air along the outside of the closed circuits 4*a* and 4*b*, thereby improving the heat transfer between the ambient air and the heat transfer fluid in the closed circuit 4. If desired, the fans 14 can also be placed on other than the indicated positions, dependent on how the ambient air is to be directed (downwards, upwards, under a certain angle, etc.).

If desired, several apparatus 1 may be positioned next to each other (see also FIG. 5).

FIGS. 5-10 schematically show a cross-sectional view of further embodiments of an apparatus 1 in accordance with the present invention.

In FIG. 5 several apparatus 1 are shown in parallel. In the apparatus 1 as shown in FIG. 5 no separation wall 18 is present between the separate tubes (or bundles of tubes) for the downwards flowing part 40A and the upwards flowing part 40B of the heat transfer fluid.

As shown in FIG. 5, two adjacent apparatus 1 may share one and the same fan 14 to force the ambient air along the outside of the closed circuits 4*a* and 4*b*. In FIG. 5, the fans 14 are shown near the upside part of the apparatus 1, forcing the ambient in a downwards direction. The person skilled in the art will understand that the fans 14 may be placed on other positions.

Also it is shown in FIG. 5 that the outside of the closed circuits may be provided with heat transfer improvers such as fins 19. Instead of the fins 19 e.g. also grooves or the like may be used. As indicated in FIG. 5, the outsides of the closed circuits may be provided with fewer or more fins, as is appropriate.

In FIG. 6 the box 15 has a rectangular design. Further the fan 14 is placed on or near the ground, while forcing the ambient air in an upwards direction.

In FIG. 7 it is shown that the upward flowing part 40B of the heat transfer fluid is reintroduced into the box 15 at a point (inlet 16) that is gravitationally higher than the outlet 17 of the box 15.

In FIG. 8 it is shown that the support frame 9 comprises a single support leg. Further it is shown that (similar to FIG. 7) the upward flowing part 40B of the heat transfer fluid is reintroduced into the box 15 at inlet 16 that is gravitationally higher than the outlet 17 of the box 15.

FIG. 9 shows a "tube in tube" arrangement wherein the downwards flowing part 40A of the heat transfer fluid is surrounded by (but thermally insulated by wall 18 from) the upwards flowing part 40B of the heat transfer fluid.

FIG. 10 shows an embodiment in which no separation wall (18: cf. FIG. 4) is present. In the embodiment of FIG. 10, at least a part of the inside of the closed circuits 4*a*, 4*b* (i.e. the tubes or pipes through which the heat transfer fluids flow) is provided with a lining 22 of an adhesion increasing material to obtain a better liquid distribution along the surface of these closed circuits. This adhesion increasing material forming the lining 22 may be e.g. in the form of a conductive porous or sponge material or may be an embossed or rugged surface.

According to the embodiment of FIG. 10, the liquid heat transfer fluid coming from the first heat transfer zone 2 is distributed via the lining 22 over the second heat transfer zone 3. After vaporization of the liquid heat transfer fluid in the second heat transfer zone 3, the vaporized heat transfer fluid rises upwards and is recycled to the first heat transfer zone 2.

In FIG. 10, only a part of the inside of the closed circuits 4*a*, 4*b* is provided with the lining 22 of adhesion increasing material. If desired, all or substantially all walls of the closed circuits 4*a* and 4*b* may be provided with such a lining 22.

The person skilled in the art will readily understand that many modifications may be made without departing from the scope of the invention.

What is claimed is:

1. A method for vaporizing a liquid stream, the method at least comprising the steps of:

a) feeding a heat transfer fluid to a first heat transfer zone, the heat transfer fluid being cycled in a closed circuit;

b) feeding a liquid stream to be vaporized to the first heat transfer zone;

c) providing heat from the heat transfer fluid to the liquid stream across a heat transfer surface in the first heat transfer zone thereby vaporizing the liquid stream and at least partially condensing the heat transfer fluid;

d) removing the vaporized liquid stream obtained in step c);

e) removing the at least partially condensed heat transfer fluid obtained in step c) and passing the at least partially condensed heat transfer fluid to a second heat transfer zone such that the at least partially condensed heat transfer fluid flows from the first heat transfer zone into a downward flowing part, wherein the heat transfer fluid flows downward in the downward flowing part;

f) providing heat from ambient air to the at least partially condensed heat transfer fluid across a heat transfer surface in the second heat transfer zone thereby vaporizing the heat transfer fluid;

g) recycling the vaporized heat transfer fluid to the first heat transfer zone wherein the vaporized heat transfer fluid flows upward in an upward flowing part and from the upward flowing part into the first heat transfer zone;

wherein the upward flowing part is provided with heat transfer improvers and wherein the downward flowing part is not provided with heat transfer improvers, wherein the heat transfer fluid is recycled in step g) using gravitational force exerted on the heat transfer fluid being cycled in the closed circuit; and, wherein the first heat transfer zone is supported by a support frame, said support frame comprising through going holes for indirectly exchanging heat between the heat transfer fluid and the ambient air.

2. The method according to claim 1, wherein no pump is used for circulation of the heat transfer fluid in the closed circuit.

3. The method according to claim 1, wherein the heat transfer fluid comprises more than 90 mole % $CO_2$.

4. The method according to claim 1, wherein the heat transfer fluid is cycled at a pressure in the closed circuit and wherein the heat transfer fluid has a boiling point below 5° C. at the pressure.

5. Method according to claim 4, wherein the heat transfer fluid comprises a compound that is selected from the group consisting of $CO_2$, ethane, ethene, propane, propene, butane and a mixture thereof.

6. The method according to claim 1, wherein the heat transfer fluid comprises 100 mole % $CO_2$.

7. The method according to claim 1, wherein the heat transfer fluid is cycled at a pressure in the closed circuit and wherein the heat transfer fluid has a boiling point from −10 to 0° C. at the pressure.

8. The method according to claim 1, wherein said heat transfer improvers comprise at least one of fins and grooves.

9. The method according to claim 1, wherein the downwards flowing part and the upwards flowing part are separated by a separation wall.

10. The method according to claim 9, wherein the separation wall is thermally insulated.

11. The method according to claim 1, wherein the second heat transfer zone comprises separate tubes or bundles of tubes for the downwards flowing part and the upwards flowing part.

12. The method according to claim 1, wherein said heat transfer improvers improve transfer of heat from the ambient air to the heat transfer fluid.

13. The method according to claim 1, wherein the liquid stream to be vaporized is a liquefied natural gas stream.

14. The method according to claim 13, further comprising obtaining the liquefied natural gas stream from a source by use of a pump, whereby the pump passes the liquefied natural gas stream to the first heat transfer zone in step b).

15. The method according to claim 14, further comprising obtaining a gaseous natural gas stream in step c) and sending the gaseous natural gas stream to a gas pipe network.

16. The method according to claim 15, further comprising a back-up heater to provide extra heat to at least one of the heat transfer fluid, the liquefied natural gas stream, and the gaseous natural gas stream so as to provide a vaporized natural gas stream to the gas pipe network.

17. An apparatus for vaporizing a liquid stream, the apparatus at least comprising:

a first heat transfer zone having a heat transfer surface for exchanging heat between a liquid stream to be vaporized and a heat transfer fluid;

a second heat transfer zone having a heat transfer surface for exchanging heat between the heat transfer fluid and ambient air to vaporize the heat transfer fluid;

a closed circuit for the heat transfer fluid comprising a downward flowing part and an upward flowing part for recycling the vaporized heat transfer fluid to the first heat transfer zone whereby the vaporized heat transfer fluid flows upward in the upward flowing part and from the upward flowing part into the first heat transfer zone;

wherein the second heat transfer zone is situated gravitationally lower than the first heat transfer zone and wherein the upward flowing part is provided with heat transfer improvers and wherein the downward flowing part is not provided with heat transfer improvers, and wherein the first heat transfer zone is supported by a support frame, said support frame comprising through going holes for indirectly exchanging heat between the heat transfer fluid and the ambient air.

18. Apparatus according to claim 17, wherein the closed circuit comprises one or more closed circuits, the one or more closed circuits forming one or more support legs in the support frame.

19. Apparatus according to claim 18, wherein the support frame includes more than one support leg, the support legs comprising at least a first and a second support leg defining an angle $\alpha$ between them.

20. Apparatus according to claim 17, wherein no pump is present for circulation of the heat transfer fluid in the closed circuit.

21. Apparatus according to claim 17, wherein said heat transfer improvers comprise at least one of fins and grooves.

22. Apparatus according to claim 17, wherein the downwards flowing part and the upwards flowing part are separated by a separation wall.

23. Apparatus according to claim 22, wherein the separation wall is thermally insulated.

24. Apparatus according to claim 17, wherein the second heat transfer zone comprises separate tubes or bundles of tubes for the downwards flowing part and the upwards flowing part.

25. Apparatus according to claim 17, wherein the liquid stream to be vaporized is a liquefied natural gas.

26. Use of $CO_2$ as a heat transfer fluid or as a component thereof, comprising cycling the $CO_2$ in the heat transfer fluid in a closed circuit between a first heat transfer zone and a second heat transfer zone, wherein the heat transfer fluid is at least partially condensed in the first heat transfer zone, and vaporized in the second heat transfer zone having a heat transfer surface for exchanging heat between the heat transfer fluid and ambient air to vaporize the heat transfer fluid, and wherein gravitational force exerted on the heat transfer fluid is used to cycle the heat transfer fluid in the closed circuit, wherein the closed circuit comprises a downward flowing part and an upward flowing part for recycling the vaporized heat transfer fluid in the upward flowing part to the first heat transfer zone whereby the vaporized heat transfer fluid flows upward in the upward flowing part and from the upward flowing part into the first heat transfer zone, and wherein the upward flowing part is provided with heat transfer improvers and the downward flowing part is not provided with heat transfer improvers; and, wherein the first heat transfer zone is supported by a support frame, said support frame comprising through going holes for indirectly exchanging heat between the heat transfer fluid and the ambient air.

27. Use according to claim 26, wherein the heat transfer fluid is intended for vaporizing a fluid, the fluid to be vaporized having a temperature below 5° C.

* * * * *